United States Patent [19]

Bellis et al.

[11] 4,416,364

[45] Nov. 22, 1983

[54] COIN VALIDATING ARRANGEMENT

[75] Inventors: Robert D. Bellis, near Oldham; Dennis Wood, Denshaw, both of England

[73] Assignee: Coin Controls Limited, Royton, England

[21] Appl. No.: 211,128

[22] Filed: Nov. 28, 1980

[30] Foreign Application Priority Data

Dec. 4, 1979 [GB] United Kingdom ..... 7941789

[51] Int. Cl.[3] ..... G07D 5/08

[52] U.S. Cl. ..... 194/100 A; 194/1 D; 194/DIG. 20

[58] Field of Search ..... 194/1 C, 1 D, 1 E, 99, 194/100 A, 101, DIG. 20

[56] References Cited

U.S. PATENT DOCUMENTS

| | | | |
|---|---|---|---|
| 790,641 | 5/1905 | Kitsee | 194/100 A |
| 1,200,725 | 10/1916 | Grover | 194/99 |
| 2,596,122 | 5/1952 | Broussard | 194/101 |
| 3,481,443 | 12/1969 | Meloni | 194/100 R |
| 3,797,628 | 3/1974 | Fougere et al. | 194/99 |
| 4,111,292 | 9/1978 | Dixon | 194/101 |
| 4,243,133 | 1/1981 | Nicolas | 194/97 R X |

*Primary Examiner*—F. J. Bartuska

*Attorney, Agent, or Firm*—Wolf, Greenfield & Sacks

[57] ABSTRACT

A coin validating arrangement for a coin operated machine, comprising a coin chute (5) having an upstream coil (8) for sensing a true coin and producing a Q signal output only when a true coin is properly inserted, an obturator (11) generally downstream of the true coin sensing coil, a coin acceptance coil (21) generally downstream of the obturator, and a validating circuit (41) which enables the coin acceptance coil to produce an A signal output which in turn generates an accept signal which activates the machine only when no Q signal output is being produced. In a preferred arrangement, an intermediate or zoning coil (18) produces a Z signal output as it watches the coin through the obturator from the Q coil to the A coil, and production of the accept signal is also dependent on the Z signal.

32 Claims, 8 Drawing Figures

52
30
30A
32
38
37
K
J
31
39
41a
51
50
35
36
36a
33
34
40
40a
41B
54
55
12V
0V
44
43
T

COIN VALIDATING ARRANGEMENT

FIELD OF THE INVENTION

This invention relates to a coin validating arrangement for a coin operated mechanism. Such mechanisms may, for example, be used in vending or amusement machines, ticket issuing machines, turnstile or barrier controlling machines. Throughout this specification, the coin validating arrangement will be described in terms of coin operation but it will be appreciated it could equally well be token operated.

BACKGROUND OF THE INVENTION

In amusement and vending machines, it has been usual in the past to allow a coin inserted therein to fall under gravity past one or more mechanical coin validating mechanisms which, if cleared, permit the coin to trip an activating switch at an acceptance point and thereby activate the machine. If the validating mechanisms are not cleared because the coin is not acceptable for some reason, then it is directed at the end of its path into a separate reject cup for collection by the person using the machine. There are several problems associated with such mechanisms.

1. Their vertical drop between coin entry slot and reject cup means that vending or amusement machine manufacturers have to design their machine to allow space for the return of a rejected coin.
2. The reject cup is a point of entry for wires or other means whereby a person can cheat the machine.
3. The vertical drop of the coin from entry slot to its acceptance point means that there is less vertical space available for coin pay out tubes, cash boxes etc. because the bottom of the coin mechanism dictates the maximum height of the payout tube etc. as it must fall from the mechanism into the tube.

These problems essentially arise because of the requirement to provide the one or more coin validating mechanisms on the vertical drop. In order to accommodate such mechanisms with working space, the vertical drop between coin entry slot and reject cup must be a substantial distance.

OBJECTS OF THE INVENTION

It is an object of the present invention to provide a coin validating arrangement which can overcome or substantially reduce the above disadvantages, in particular enabling the need for a coin reject path and associated coin reject cup to be dispensed with.

It is a further object of the invention to provide an electronic coin validating arrangement which, while being compact and of short path length, can enable various cheats on the machine to be prevented without resort to a succession of mechanical coin validators.

BRIEF SUMMARY OF THE INVENTION

According to one aspect of the invention there is provided a coin validating arrangement comprising a coin guide path leading past a coin acceptance obturator operable by an electric driver, a coin sensing coil at an upstream zone of the guide path ahead of the obturator, said coil forming part of a circuit which is operable to initiate an obturator opening signal only when a true coin is sensed, and a sensing coil at a downstream zone of the guide path beyond the obturator, said downstream coil forming part of a further circuit which is operable to produce a coin acceptance signal only when both a coin is sensed in said downstream zone and an input indicative of the absence of an output signal from the upstream coil is presented at said further circuit.

In a preferred arrangement a further sensing coil is provided at an intermediate zone of the guide path at which the obturator is operative, such intermediate sensing coil forming part of a circuit which is operable to produce an obturator-open maintenance signal only when a coin is sensed in said intermediate zone, while the upstream coil circuit is operable to produce an obturator-open continuation signal as a coin is sensed leaving the upstream zone to enter the intermediate zone. It is thereby possible to "watch" the coin for the full length of the guide path to the acceptance point.

According to another aspect of the invention, in a coin validating arrangement having a sensing coil at an upstream zone of the guide path, a coin receiving slot is provided at the coin guide path entrance, the obturator normally blocking passage of a coin from said slot past the upstream zone of the coin path but being movable out of the coin path when the upstream coil senses that a true coin has been received in the coin receiving slot, and means operable to move the obturator to re-present the coin at the coin receiving slot if the obturator opening signal is not initiated.

Further features and advantages of the invention will become apparent from the following description of preferred embodiments, by way of example only, with reference to the accompanying drawings.

DESCRIPTION OF EMBODIMENT

Figure 1:
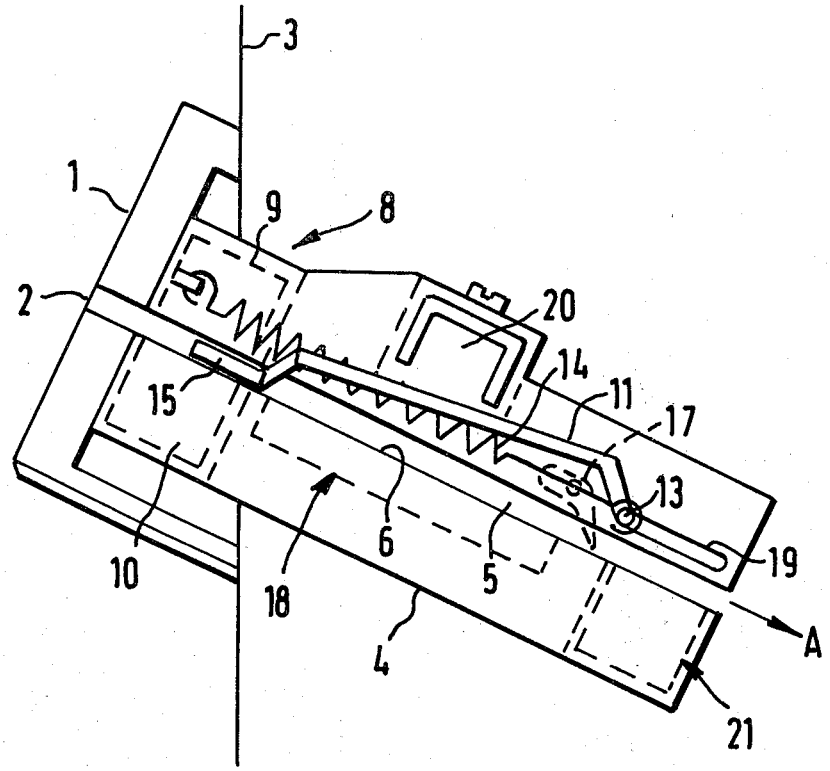
FIG. 1 is a schematic side view, partly in section, of one form of coin validating arrangement with an obturator in its rest position prior to the insertion of a coin.
Figure 3:
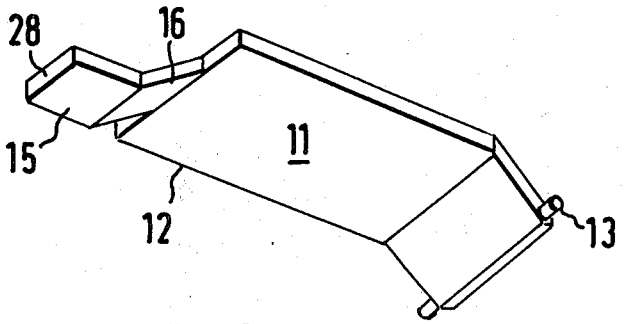
FIG. 3 is a perspective view of a slide which forms part of the obturator of FIGS. 1 and 2.
Figure 2:
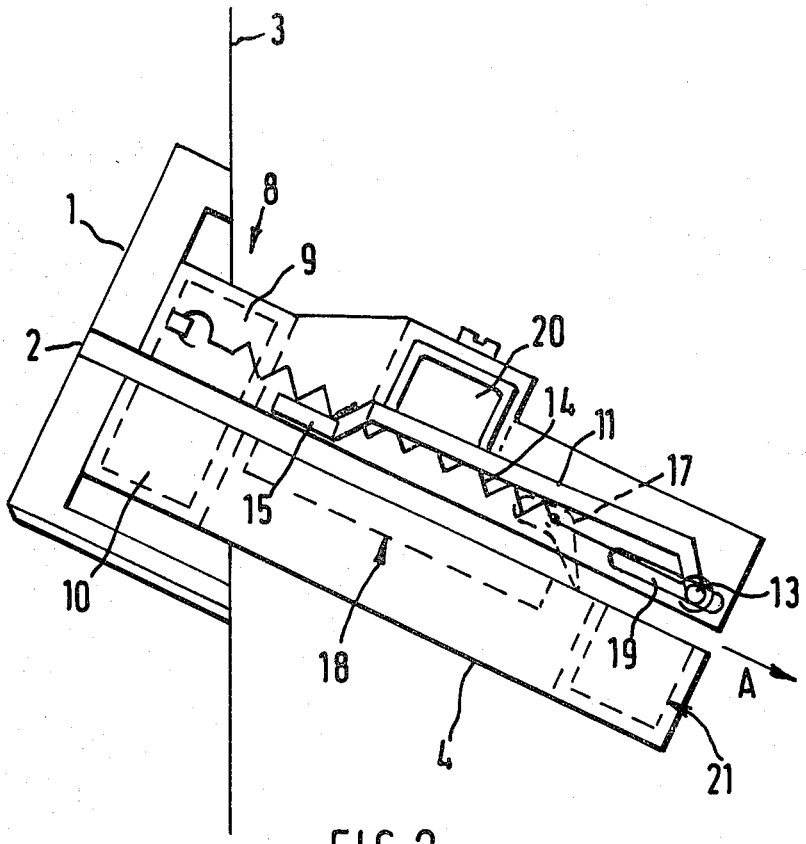
FIG. 2 is a view of the embodiment of FIG. 1 but with the obturator in its open position.

Referring to FIGS. 1 to 3 of the drawings, there is shown a coin validating arrangement mounted on a bezel 1 provided with a coin or token receiving slot 2, which could alternatively be vertical or horizontal if desired. The bezel 1 is attached to a face plate 3 by suitable means (not shown), the face plate also including means for attachment thereof to the amusement, vending or other machine to which the whole arrangement is to be fitted.

The coin mechanism comprises a body member 4 formed therein with a coin chute or channel 5, the bottom 6 of which is mounted with respect to the bezel 1 so that it is coplanar with the coin slot 2. The coin chute 5 is arranged at an angle to the horizontal, conveniently between 25° and 45°, so that a coin inserted in the slot can slide under gravity down the chute 5 in the direction of arrow A.

At an upstream zone of the chute 5 just downstream of the coin receiving slot 2 is provided a pair of sensing coils 9, 10, generally referred to in this description as the Q coil 8. The coils are incorporated in electronic coin validating circuitry described hereinafter with reference to FIGS. 4 to 7. The Q coil 8, when it senses a true coin, gives rise to production of a signal which operates through an electric driver and solenoid 20 to open an obturator or slide 11 to permit passage of the true coin down the chute 5 towards the machine to be operated.

The acceptance slide 11 comprises a body portion 12 provided on each side at the rear with trunnions 13 to which biassing springs 14 are attached. The trunnions 13 engage in longitudinal slots 19 in the body member 4 to enable the slide 11 to be displaced rearwardly against the action of the springs 14, the latter being fixed at their remote ends to the front of the body member. The slide has a foot 15 extending from one end thereof which is stepped down at 16, the foot 15 being generally parallel to the body portion 12 but in a different plane. The trunnions 13 also define a pivot about which the slide 11 can turn when the solenoid 20 is operated.

With this arrangement, it will be seen that on insertion of a coin in the slot 2, the coin will initially come to rest against end 28 of the acceptor slide foot 15. Light pressure on the coin will cause the slide 11 to move generally parallel to the coin chute 5 until the trunnions 13 are in a position towards but, in order to avoid risk of jamming, spaced from the rear end of their respective slots 19. In this position, the foot 15 will still be resting on the bottom 6 of the coin chute 5. When the slide 11 is in this rearward position, the coin will have been pressed into the coin receiving slot 2 past its centre line, into the upstream zone of the chute. If the Q coil 8 accepts the coin, and subject to the action of the validating circuitry described hereinafter, the solenoid 20 positioned above the slide 11 is energised. This causes the slide 11 to be pivoted upwardly into the position shown in FIG. 2, where the foot 15 is now also out of the path of the coin so it can slide under gravity into the intermediate zone of the chute 5.

If the coin is not accepted by the Q coil 8, either because it is false or the machine is disconnected or still operating from a previous customer, the coin can still be pushed a short way into the slot from its rest position shown in FIG. 1 but only until the trunnions 13 abut the end of the slots 19. Because the Q coil 8 has not accepted the coin, it does not initiate energisation of the solenoid 20 so the foot 15 remains in its lower position and occludes the path of the coin. On release of pressure on the coin by the customer, the spring loaded slide 11 returns the coin to its rest position and re-present it to the customer at the entrance slot 2.

A major advantage of the mechanism just described is that it avoids the need to provide a reject cup for non-accepted coins due to the fact that they are re-presented to the customer through the same slot as has been used to insert the coin in the mechanism, this being made possible by the use of the spring loaded acceptor slide in combination with the Q coil which senses the presence of a true coin and initiates energisation of the solenoid 20 or other means to cause the side 11 to move out of the path of the coin so that it can travel under the action of gravity further into the chute 5.

Also shown in FIGS. 1 and 2 is an extended sensing coil 18, referred to hereinafter as the Z coil, forming part of the validating circuitry. The purpose is to watch the passage of the coin down the chute 5, in effect to ensure that nothing is attached to the back of the coin, such as sewing thread, fishing line, adhesive tape etc., by means of which the coin may be lowered past the Q coil to activate it and then withdrawn.

The device also includes a third testing station, which comprises a downstream sensing coil 21, referred to hereinafter as the A coil, beyond the slide 11. The A coil also forms part of the electronic validating circuitry described hereinafter with reference to FIGS. 4 to 7. Primarily, it acts as an accept switch to send an accept signal to the vending or gaming machine to which the coin validating arrangement is fitted, which signal energises the operating mechanism thereof so that the machine can perform the function required of it by the customer. However, as will be made clear later, it cannot generate this accept signal unless the Q coil 8 output signal has ceased, i.e. the upstream zone of the chute 5 is empty.

Also shown in FIGS. 1 and 2, in dotted line, is a coin non-return catch 17, located at the downstream end of the intermediate zone of the chute. A coin must reach the A coil to produce the accept signal, and cannot then be recovered by use of attached sewing thread or the like.

Figure 4:
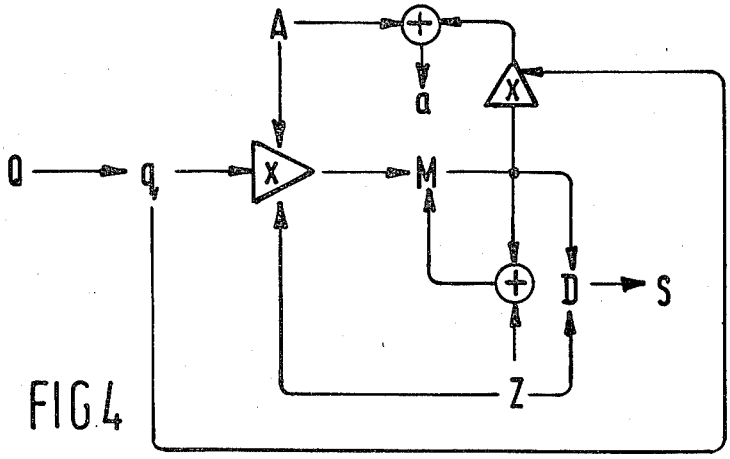
FIG. 4 is an electronic function flow chart forming the basis of coin validation.

Turning now to the electronic validating circuitry of FIGS. 4 to 7, in which the Q coil, Z coil and A coil are incorporated, FIG. 4 is a simplified electronic function flow chart.

Each coil is associated with an oscillator. The normal mode of the Q oscillator circuit when properly adjusted is such that only a true coin can quench (reduce the amplitude) of the oscillations. This causes the oscillator to change its mode of operation such that it is more easily quenched. Thus, the true coin, having initiated a Q output, is able to move partly out of the upstream zone of the chute to begin to enter the intermediate zone, giving rise to a q output from the Q oscillator circuit. A q output cannot be produced except in consequence of an initial Q output.

The Q output followed by the q output is fed through a disabler X to a memory M. Signals arriving at the disabler X either from the A or Z oscillator circuits can disable the Q or q signal being fed to the memory M.

A second output from the Z oscillator circuit is fed to a comparator or AND function device (+), which also receives an output from the memory M. Only if all signals fed into this comparator are true will a true output be produced. A true output is fed back to the memory M to refresh it.

The memory M will transmit an output signal in response to any input signal (from the Q oscillator circuit or the comparator) and will continue to transmit an output signal for a short period after all inputs are discontinued.

The driver D for the slide or obturator S is operable by the output of the memory M or a third output from the Z oscillator circuit.

The output from the memory also passes to a conditional gate X also receiving an input (Q or q) from the Q oscillator circuit. This conditional gate X produces an output only if the memory output is present in the absence of a Q or q output.

The output of the conditional gate X is fed to a second AND function device (+) also receiving the output of the A coil oscillator circuit. An accept signal a is produced only when this second AND function device is receiving both an A signal and the memory output without a Q or q signal.

Reference is now made, in a general way, to the oscillator circuits. The Q coil is part of a tuned circuit coupled into a negative feedback path of an amplifier whereby a phase shift is produced sufficient to result in positive feedback and oscillation in said amplifier in the absence of a true and correct coin at the region of said path adjacent one or both said coils, the tuned circuit being arranged so that on passage of a true and correct coin past said region, the oscillation is quenched or reduced in amplitude. It will be appreciated that passage of a coin past the Q coil causes energy losses to occur which affect its Q factor. In the case of a coin of non-ferrous or non-magnetic materials, the energy losses are mainly the result of eddy currents set up within the coin. Ferrous coins affect the alternating field of the Q coil by a magnetic hysteresis effect, due to residual magnetism in the coins. The magnitude of the energy loss depends on the nature and size of the coin. Coins of alloys and metals having high resistivity cause higher energy losses than others.

By adjusting the operating parameters of the amplifier/oscillator and tuned circuit, a sensitive response to a given correct coin of given diameter can be ensured.

Furthermore, by introducing a mode switching transistor circuit into the Q oscillator circuit, in parallel with the negative feedback path, it can be arranged that the initial Q quench operates the mode switching transistor to introduce additional impedance into the tuned circuit, whereby the latter can remain quenched by only the trailing part of the coin as it falls under gravity down the upstream zone of the chute. Effectively, hysteresis is introduced into the Q coil, whereby sensing is still carried out but at a much reduced selectivity.

In contrast, in the case both of the Z oscillator circuit and the A oscillator circuit, the circuit parameters are permanently selected so that an output signal is provided if any metal object, either the whole or a part thereof, is sensed.

Figure 5:
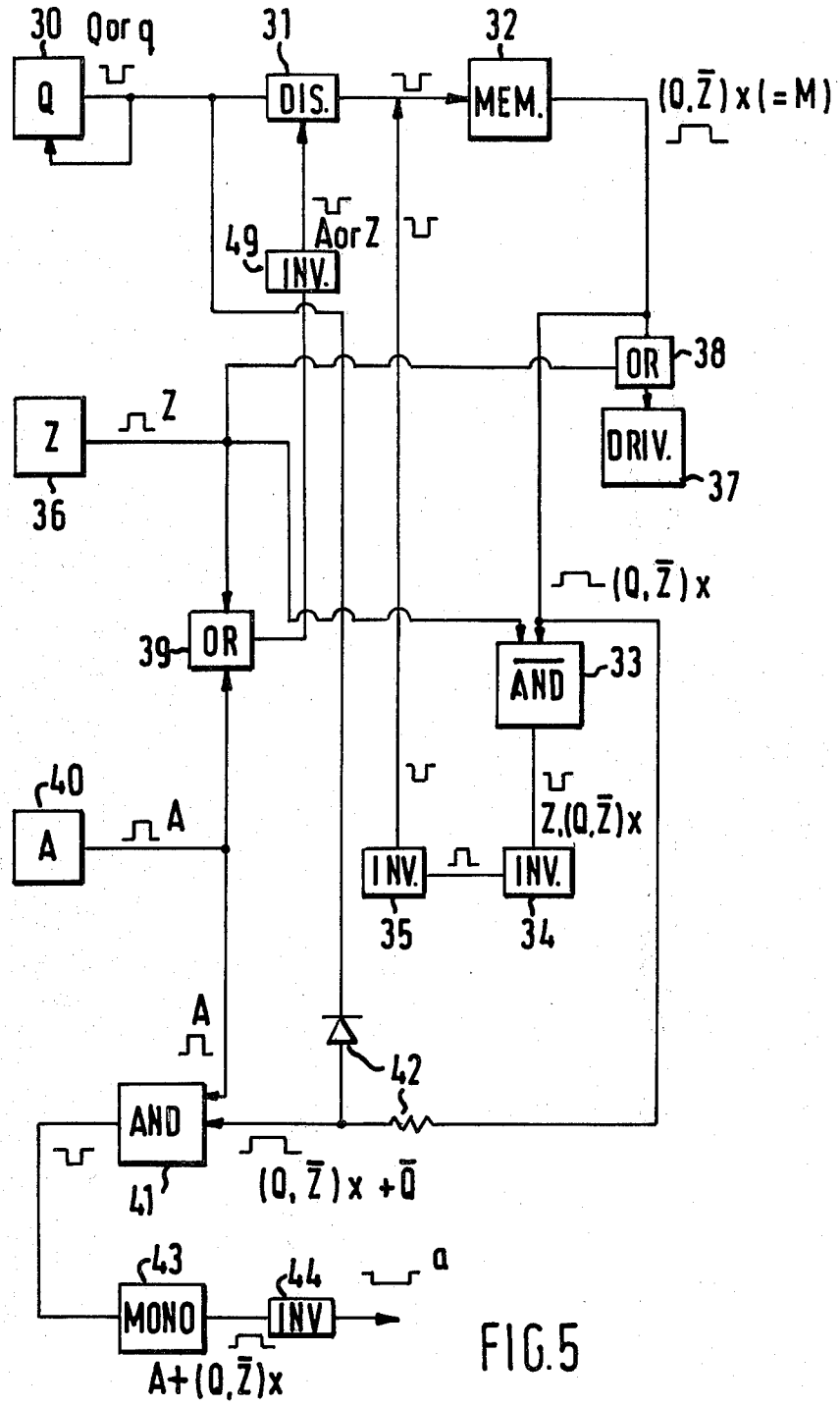
FIG. 5 is a functional block diagram of one arrangement of the coin validating arrangement circuitry.

Reference is now made to the more detailed but still diagrammatic function block diagram of FIG. 5. In this diagram, the Q coil oscillator circuit is referenced 30, with its output (Q or q) fed to the disable circuit 31, which in turn outputs to the memory 32. The memory output M connects through a feedback loop including NAND gate 33, inverters 34 and 35 to the memory input, the NAND gate having a second input Z from the Z coil oscillator circuit referenced 36. Thus the memory output M, sustained for a predetermined period in response to any input, is (Q (or q), $\overline{Z}$)x, where x represents the period for which the signal output is sustained. The output of the NAND gate 33 is also (Q, $\overline{Z}$)x, which is used to refresh the memory. The memory output M also constitutes an energising signal for the obturator or slide driver 37. Preferably, as indicated, this driver energising signal is fed through an OR gate 38 having a second input Z direct from the Z coil oscillator circuit 36.

When the coin leaves the upstream zone of the chute entirely, the q signal ceases. However, the memory 32 continues to be refreshed via NAND gate 33 by the Z signal, as the coin is now travelling through the intermediate zone. Additionally, the Q or q signal is disabled at the disable circuit 31 when a Z signal is being produced. Thus the Z signal is fed to the disable circuit through an OR gate 39 having a second input from the A coil oscillator circuit referenced 40, so that the production of either a Z signal or an A signal will disable the Q or q signal.

The A signal is output to a conditional AND gate 41, which has a second input jointly from the memory 32 and from the Q coil oscillator circuit 30 via an inverter 49 and isolating device 42. The conditional gate 41 produces an output to a monostable timer 43 only if no Q (or q) signal is present at its second input. The accept signal (a) for activating the machine is output from an inverter 44 on the output side of the monostable timer 43.

The electronic validating arrangement thus far described is able to avoid the following possible cheats on the machine to which it is applied.

First, the Q coil circuit 30 provides a true and correct coin test. A fraudulent or incorrect coin or token cannot produce the Q signal. Thus, no obturator opening signal is initiated, and the incorrect item is rejected and represented at the entrance slot in the manner described with reference to FIGS. 1 to 3.

Second, insertion of a correct coin to activate the Q coil circuit 30, followed by true coin withdrawal in readiness for insertion of a false coin, will cause failure of the memory due to absence of a subsequent Z signal, resulting in immediate re-closure of the obturator. Obviously, no A signal will be generated.

Third, manual lifting of the obturator (with a knife or other suitable implement), suspending a non-true coin on a thread through to the Z coil or the A coil, and temporarily entering a true coin to activate the Q coil so that the non-true coin can then be released and the true coin withdrawn, will also result in failure to generate an accept (a) signal. Either the Z or A signals will block the Q signal to the memory 32, or the Q (or q) signal will block the output signal M from the memory through the conditional gate 41, according to circumstances.

Fourth, if the same procedure is adopted as in the third case, but the true coin is suspended through to the Z coil prior to its withdrawal, the same blocking functions will occur.

Fifth, if a true coin is suspended right through the arrangement to the A coil, it cannot then be withdrawn owing to the presence of the coin non-return catch referred to in connection with FIGS. 1 to 3.

A final possible cheat which could be effected is that of attaching a true coin by its edge to a plastics or non-metallic bar (which will not sustain the q signal once the coin has passed through) which could over-ride the non-return catch and make it possible to retrieve the true coin after the accept (a) signal has been generated. This procedure can be foiled by fitting an obturator sensor which will hold the A signal until the obturator has returned to its rest position. For example, the initial produced A signal can be numerized, to be cancelled when a returning coin passes the Z coil. Since this cancellation would occur before the obturator could return to its rest position, no accept (a) signal would be generated.

Figures 6, 6A:
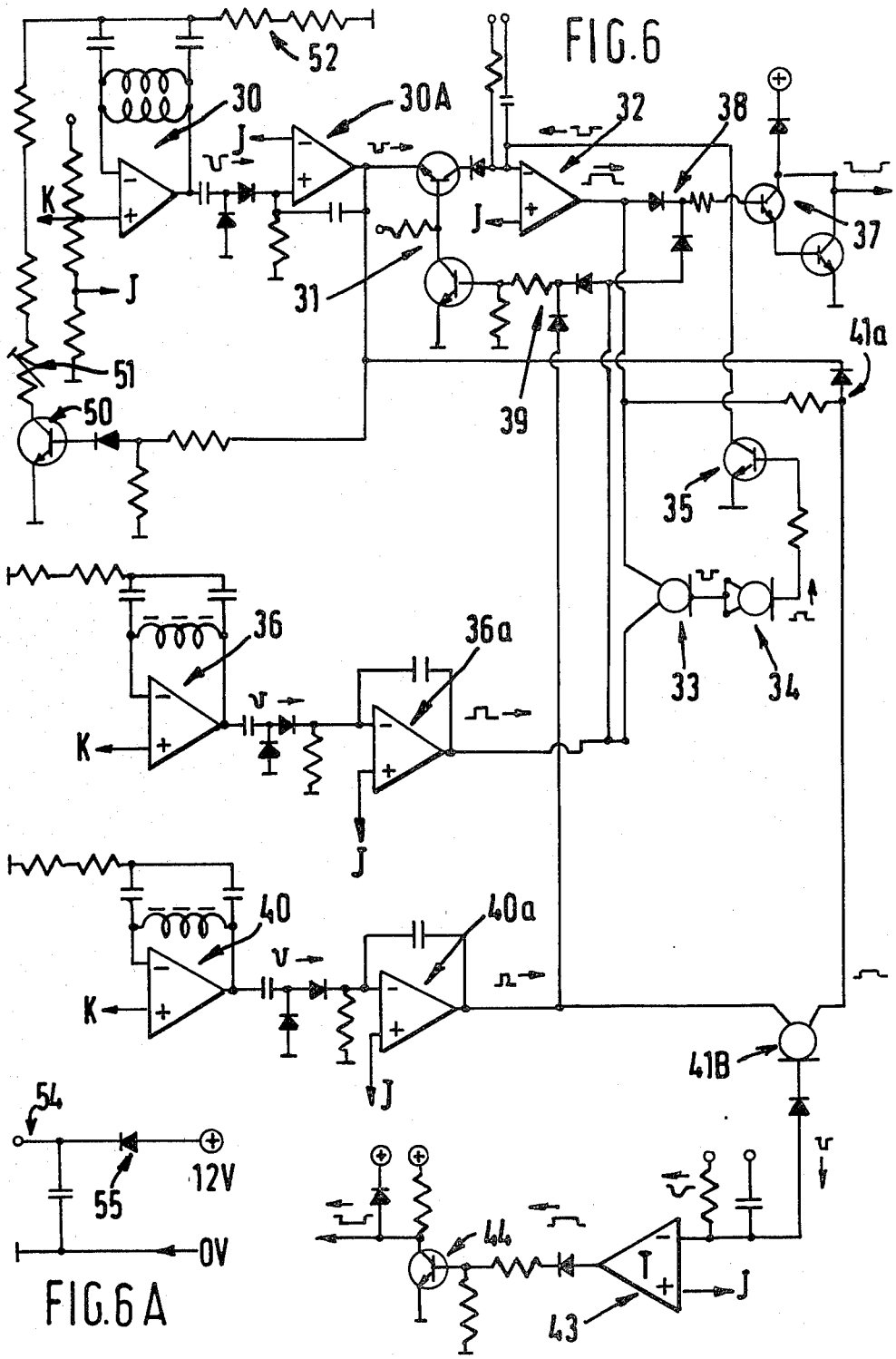
FIG. 6 is a diagram of one practical circuit construction.
FIG. 6A shows a power supply circuit.

A practical circuit diagram is shown in FIG. 6. This circuit will not be described in detail, since its operation will generally be made apparent by consideration of the applied reference numerals, which are identical to those already used in connection with FIG. 5. It should be mentioned, however, that the references 30A, 36A and 40A are used to designate the demodulators and threshold setters for the Q, Z and A oscillators, respectively, while in the Q oscillator circuit 30, the reference 50 denotes the previously mentioned mode switching transistor and the reference 52 the resistors selected for the q quench mode. The adjustable resistor 51 is for fine setting of the Q quench mode.

FIG. 6 also makes clear the form of the conditional AND gate 41 of FIG. 5. This comprises a "NOT M if Q function" device 41A and an AND gate 41B.

FIG. 6A shows the power supply lines 54, which include a reverse polarity protection diode 55.

Figure 7:
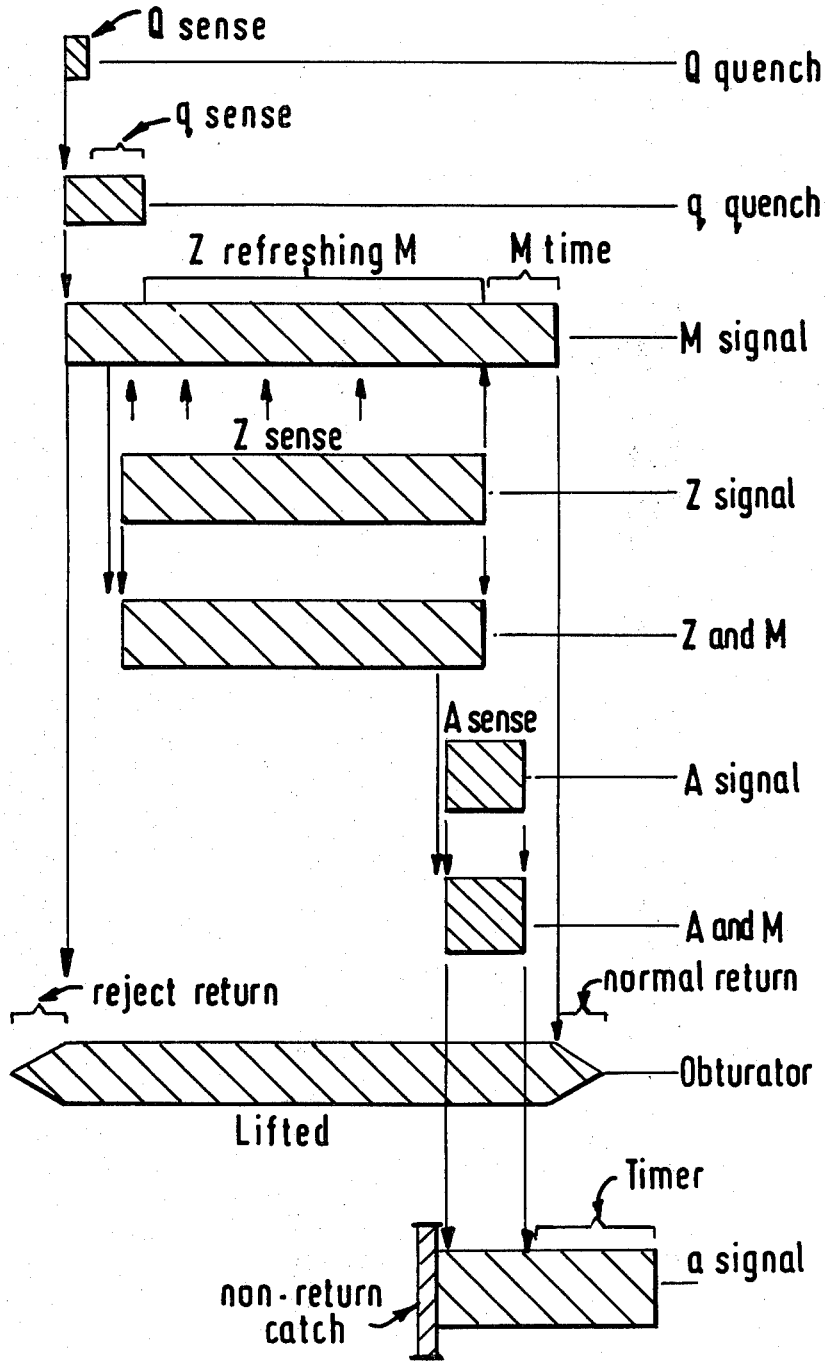
FIG. 7 is a diagram showing the operational sequence of the coin validating arrangement.

Finally, FIG. 7 will make clear the timing sequence of the arrangement. This diagram shows the manner in which the coin is watched right along the coin guide path through the obturator, so that any interruption of the correct and timed sequence of functions will result in figure to produce an accept (a) signal which will activate the machine to which the coin validating arrangement is fitted.

Certain further advantages of the abovedescribed arrangement should also be mentioned. First, the whole device can be constructed in very compact form, placing minimum restriction on the provision and location of other parts of the machine to which the device is fitted. Second, as will be clear from FIG. 2, with the obturator lifted, clear access for cleaning and maintenance of the coin chute is presented. Third, the arrangement is suitable for front fitting or table top fitting, without modification except in the shape of the bezel. Fourth, the Q coil can be made as selective or sensitive as required. For example, for increased selectivity comparators can be connected to the Q oscillator circuit in such a way as to be triggered by attenuation of the amplitude of the oscillator signal due to a particular coin. Used in conjunction with frequency and phase comparisons, capability for testing more than one type of coin could be achieved. Such an arrangement may be facilitated by the use of one driven coil and one oppositely placed search coil or a plurality of specially positioned smaller search coils.

It should also be mentioned that interference between the Q, Z and A coils is readily minimised, avoiding the need for electromagnetic screening, by appropriately orientating the axes of these coils relatively to one another. In the preferred arrangement, and making reference back to FIG. 1, the axis of the Q coil 8 is orientated in the plane of the paper normal to the chute 5, the axis of the Z coil 18 is orientated normal to the plane of the paper and the axis of the A coil 21 is orientated in the plane of the paper parallel to the chute 5.

Furthermore, various modifications of the described arrangement are possible within the scope of the appended claims. One modification to be mentioned is that of using the Q coil for the additional purpose of driving the obturator back forwardly to its rest position when no obturator opening signal is initiated. Such an arrangement could enable the obturator return spring to be dispensed with. In the electronic validating circuitry, various modifications and simplifications can be introduced, depending on the extent of validation required. One possible modification lies in the arrangement of the Q coil circuit. Instead of changing the sensitivity of the circuit, the reduced quenching effect due to presence of only part of a true coin which is moving on into the intermediate zone of the Z coil can be examined at the output of the Q circuit demodulator, and suitable circuitry can then be operative, having been satisfied by an initial Q signal, to generate a q signal supplied to the memory.

One most important cheat to be guarded against is the suspension of a false coin through the chute coupled with the temporary insertion of a true coin into the receiving slot (to activate the Q coil circuit). This cheat is prevented, in accordance with the invention, by making the generation of the accept signal dependent on an empty receiving slot. If no further validations (other than true coin sensing) are required, arrangements can be devised wherein the intermediate or zoning coil is dispensed with.

We claim:

1. A coin validating arrangement comprising:

a coin guide path leading past a coin acceptance obturator operable by an electric driver, a coin sensing coil at an upstream zone of the guide path ahead of the obturator, a circuit of which said coil forms part and which is operable to initiate an obturator opening signal only when a true coin is sensed, a sensing coil at a downstream zone of the guide path beyond the obturator, a further circuit of which said downstream coil forms part and which is conditionally operable to produce a coin acceptance signal only when both a coin is sensed in said downstream zone and an input indicative of the absence of an output signal from the upstream coil is presented at said further circuit, a further sensing coil at an intermediate zone of the guide path at which the obturator is operative, and a third circuit of which said intermediae sensing coil forms part and which is operable to produce an obturator-open maintenance signal only when a coin is sensed in said intermediate zone, said upstream coil circuit being operable to produce an obturator-open continuation signal as a coin is sensed leaving the upstream zone to enter the intermediate zone, said upstream coil circuit comprising a tuned circuit incorporating the true coin sensing coil, which tuned circuit is quenched when a true coin is sensed thereby to initiate the obturator opening signal, and a switching means responsive to initiation of the obturator opening signal to reduce the sensitivity of the tuned circuit so that quenching rhereof is maintained as the coin is leaving the upstream zone and the obturator-open continuation signal is thereby produced, and a memory to which the signals from the upstream coil circuit are fed, said memory producing a driving signal for the obturator driver which is sustainable for a predetermined period, said driving signal also being fed to one input of a NAND gate having its other input connected to the output of the intermediate coil circuit, the output of the NAND gate being fed back to the input of the memory so that said memory is refreshed to continue to sustain the driving signal until the end of said predetermined period following commencement of the obturator-open maintenance signal produced by the intermediate coil circuit.

2. An arrangement according to claim 1, wherein the said driving signal from the memory is fed to the obturator driver through one input of an OR gate having its second input connected to receive the obturator-open maintenance signal from the intermediate coil circuit.

3. An arrangement according to claim 2, wherein the signals from the upstream coil circuit are fed to the memory through a disable circuit having an input from the intermediate coil circuit, said disable circuit being disabled by the obturator-open maintenance signal to prevent signals from the upstream coil circuit being fed to the memory.

4. An arrangement according to claim 3, wherein the obturator-open maintenance signal from the intermediate coil circuit is fed to the disable circuit through one input of an OR gate having its second input connected to the output of the downstream coil circuit, whereby the disable circuit is also disabled by the coin acceptance signal.

5. An arrangement according to claim 4, wherein the downstream coil circuit includes an AND gate having one input connected to receive a signal indicative of a coin sensed in the downstream zone and one input connected to receive the driving signal from the memory, said driving signal being fed to said AND gate through one input of a conditional gate having its second input connected to receive the output of the upstream coil circuit and to permit output of the driving signal to the AND gate only if no output is present from the upstream coil circuit, whereby the coin acceptance signal can only be produced when the upstream zone is empty.

6. An arrangement according to claim 1, including a sensor adapted to sense closure of the obturator after opening thereof, and circuit means adapted to prevent generation of the coin acceptance signal unless the gate has closed behind a coin.

7. An arrangement according to claim 1, including a coin receiving slot at the coin guide path entrance, the obturator normally blocking passage of a coin from said slot past the upstream zone of the coin path but being movable out of the coin path when the upstream coil senses that a true coin has been received in the coin receiving slot, and means operable to move the obturator to re-present the coin at the coin receiving slot if the obturator opening signal is not initiated.

8. An arrangement according to claim 7, wherein the means for moving the obturator is a spring, the obturator being arranged to be movable to permit a coin to be inserted in the coin receiving slot on the application of pressure to the coin but to re-present the coin at said slot on the release of said applied pressure if the obturator opening signal is not initiated to open the gate.

9. An arrangement according to claim 8, wherein the obturator is mounted on a pivot guidedly displaceable generally parallel to the coin guide path and spring urged on its guide forwardly towards the coin receiving slot.

10. An arrangement according to claim 9, wherein the obturator is displaced rearwardly under said applied pressure of a coin and in its rearwardly displaced position is movable about its pivot, when a true coin is sensed, into an open position permitting passage of the coin along the coin guide path.

11. An arrangement according to claim 1, wherein the obturator is spaced from the coin receiving slot to permit a coin to be at least partially inserted therein before it contacts the obturator, the obturator being yieldable under pressure of an entered coin and being returned to its initial position to re-present the coin at the coin receiving slot if an obturator opening signal is not initiated.

12. An arrangement according to claim 11, wherein the obturator is moved by a solenoid energisable by the output of the gate driver.

13. An arrangement according to claim 7, wherein the upstream sensing coil is arranged to operate only when at least one half of the coin has been inserted in the coin receiving slot.

14. An arrangement according to claim 7, including a coin non-return catch adjacent the obturator exit ahead of the downstream sensing coil.

15. A coin validating arrangement comprising:

a coin guide path leading past a coin acceptance obturator operable by an electric driver and having a coin receiving slot at the coin guide path entrance, a coin sensing coil at an upstream zone of the guide path ahead of the obturator, said obturator normally blocking passage of a coin from said slot past the upstream zone of the coin path but being movable out of the coin path when the upstream coil senses that a true con has been received in the coin receiving slot, a circuit of which said coil forms part and which is operable to initiate an obturator opening signal only when a true coin is sensed, and means operable to move the obturator to re-present the coin at the coin receiving slot if the obturator opening signal is not initiated.

16. An arrangement according to claim 15 wherein the means for moving the obturator is a spring, the obturator being arranged to be movable to permit a coin to be inserted in the coin receiving slot on the application of pressure to the boin but to re-present the coin at said slot on the release of said applied pressure if the obturator opening signal is not intiated to open the gate.

17. An arrangement according to claim 16, wherein the obturator is mounted on a pivot guidedly displaceable generally parallel to the coin guide path and spring urged on its guide forwardly towards the coin receiving slot.

18. An arrangement according to claim 17, wherein the obturator is displaced rearwardly under said applied pressure of a coin and in its rearwardly displaced position is movable about its pivot, when a true coin is sensed, into an open position permitting passage of the coin along the coin guide path.

19. An arrangement according to claim 15, wherein the obturator is spaced from the coin receiving slot to permit a coin to be at least partially inserted therein before it contacts the obturator, the, obturator being yieldable under pressure of an entered coin being returned to its initial position to re-present the coin at the coin receiving slot if an obturator opening signal is not initiated.

20. An arrangement according to claim 19, wherein the obturator is moved by a solenoid energizable by the output of the gate driver.

21. An arrangement according to claim 15 wherein the upstream sensing coil is arranged to operate only when at least one half of the coin has been inserted in the coin receiving slot.

22. An arrangement according to claim 15, including a coin non-return catch adjacent the obturator exit ahead of the downstream sensing coil.

23. A coin validating arrangement comprising a coin receiving slot opening into a coin guide path, an obturator, means mounting the obturator in a blocking position obstructing passage of all coins inserted in the slot, coin validating means positioned to sense the validity of a coin currently obstructed by the obturator, and means whereby the obturator is moved out of the blocking position to allow passage of a coin which has been validated by the validating means, the obturator being mounted to return along the coin path and re-present all non-validated coins at the coin receiving slot.

24. A coin validating arrangement as claimed in claim 23 wherein the coin validating means is one or more inductive devices operable to sense whether a true coin is present and generate a signal which is used to activate and move the obturator out of the coin path.

25. A coin validating arrangement as claimed in claim 24 wherein the obturator is returned by means of a spring, the obturator being arranged to be movable to permit a coin to be inserted in the coin receiving slot on the application of pressure to the coin but to re-present the coin at said slot on release of said applied pressure if the obturator moving signal is not initiated.

26. A coin validating arrangement as claimed in claim 23 wherein the obturator is spaced from the coin receiving slot to permit a coin to be at least partially inserted therein before it contacts the obturator.

27. A coin validating arrangement as claimed in claim 23 wherein the obturator is moved by a solenoid.

28. A coin validating arrangement as claimed in claim 25 wherein the obturator is mounted on a pivot guidedly displaceable generally parallel to the coin guide path.

29. A coin validating arrangement as claimed in claim 28 wherein the obturator is displaced rearwardly under the applied pressure of a coin and in its rearwardly displaced position is movable about its pivot, when a true coin is sensed, into an open position permitting passage of a coin along the coin guide path.

30. A coin validating arrangement comprising:

a coin guide path leading past a coin acceptance obturator operable by an electric driver, a coin sensing coil at an upstream zone of the guide path ahead of the obturator, a circuit of which said coil forms part and which is operable to initiate an obturator opening signal only when a true coin is sensed, a sensing coil at a downstream zone of the guide path beyond the obturator, a further circuit of which said downstream coil forms part and which is conditionally operable to produce a coin acceptance signal only when both a coin is sensed in said downstream zone and an input indicative of the absence of an output signal from the upstream coil is presented at said further circuit, a sensor adapted to sense closure of the obturator after opening thereof, and circuit means adapted to prevent generation of the coin acceptance signal unless the gate has closed behind a coin.

31. A coin validating arrangement comprising:

a coin guide path leading past a coin acceptance obturator operable by an electric driver, a coin sensing coil at an upstream zone of the guide path ahead of the obturator, a circuitof which said coil forms part and which is operable to initiate an obturator opening signal only when a true coin is sensed, a sensing coil at a downstream zone of the guide path beyond the obturator, a further circuit of which said downstream coil forms part and which is conditionally operable to produce a coin acceptance signal only when both a coin is sensed in said downstream zone and an input indicative of the absence of an output signal from the upstream coil is presented at said further circuit, a coin receiving slot at the coin guide path entrance, the obturator normally blocking passage of a coin from said slot past the upstream zone of the coin path but being movable out of the coin when the upstream coil senses that a true coin has been received in the coin receiving slot, and means operable to move the obturator to re-present the coin at the coin receiving slot if the obturator opening signal is not initiated.

32. A coin validating apparatus comprising:

means defining a coin guide path having a coin receiving slot, a coin obturator member disposed in the coin guide path and having a rest position, a coin enable position and a coin inhibit position, coin sensing means for sensing a coin which, when inserted in the receiving slot, causes the obturator member to be displaced towards its inhibit position, means for moving the obturator member from its inhibit position to its enable position when a valid coin is sensed, and means operable to return the obturator member from its inhibit position to its rest position and thereby re-present the coin at the receiving slot when a valid coin is not sensed.

* * * * *